US006355154B1

(12) United States Patent
Buratti

(10) Patent No.: US 6,355,154 B1
(45) Date of Patent: Mar. 12, 2002

(54) ARTICLE PLATED WITH BORON CARBIDE IN A NICKEL-PHOSPHORUS MATRIX, AND PROCESS AND BATH FOR ITS PREPARATION

(75) Inventor: Angelo Buratti, San Giuliano Milanese (IT)

(73) Assignee: SBR S.r.l., Milan (IT)

( * ) Notice: Subject to any disclaimer, the term of this patent is extended or adjusted under 35 U.S.C. 154(b) by 0 days.

(21) Appl. No.: 09/610,431

(22) Filed: Jul. 5, 2000

(30) Foreign Application Priority Data

Jul. 6, 1999 (IT) ..... MI99A1484

(51) Int. Cl.[7] ..... C25D 15/00; C25D 5/34; C25D 5/50

(52) U.S. Cl. ..... 205/109; 205/206; 205/210; 205/227

(58) Field of Search ..... 205/109, 258, 205/227, 206, 210, 187

(56) References Cited

U.S. PATENT DOCUMENTS 4,666,786 A * 5/1987 Yano et al. ..... 428/544

* cited by examiner

*Primary Examiner*—Edna Wong
(74) *Attorney, Agent, or Firm*—Oblon, Spivak, McClelland, Maier & Neustadt, P.C.

(57) ABSTRACT

The present invention relates to am article plated with boron carabide in a nickel-phosphorus matrix, obtained by a plating process comprising the following steps: a) preparation of an electrolytic bath comprising two or more nickel salts, at least one complexing agent, at least one phosphorus salt, and, in addition, an anti-tensioning agent and boron carbide in the form of powder; b) electroplating of the article in the electrolytic bath at a temperature ranging from 40° C. to 70° C., with a current density ranging from 1 to 10 A/dm$^2$; and c) heat treatment of the product thus plated. The plating is used for any article that requires a type of plating which presents high resistance to wear, and in particular for cylinders for the production of corrugated cardboard.

29 Claims, No Drawings

ARTICLE PLATED WITH BORON CARBIDE IN A NICKEL-PHOSPHORUS MATRIX, AND PROCESS AND BATH FOR ITS PREPARATION

The present, invention refers to an article plated with boron carbide in a nickel-phosphorus matrix, to the process of preparation of said article by electrodeposition of inert particles in a nickel-phosphorus matrix, and to an electrolytic, bath for obtaining said article.

In the sector of the production of articles that are subjected to severe wear and, more in particular, in the sector for producing cylinders for the production of corrugated cardboard, the role of the plating applied on the article, and in particular of the plating applied on the cylinder, is of fundamental importance. In fact, it is precisely the plating that must be able to withstand severe wear. There are two types of plating currently used in the said sector: classic chrome plating, with thicknesses of the order of 100 $\mu$m, deposited electrolytically, and tungsten-carbide plating.

Albeit having an acceptable cost, classic chrome plating presents a number of drawbacks. In the first place, it is not possible to obtain uniformity of plating; namely, plating is deficient in the groove and abundant on the sharp point on account of the point effect. As a result, the thickness in the groove may be 70% less than the thickness on the sharp point, even though an appreciable hardness is maintained (approximately 850 Hv).

The second type of plating used in the sector of plating of articles that undergo severe wear, such as cylinders for the production of corrugated cardboard, is tungsten-carbide plating. Albeit having good characteristics of hardness (approximately 1300 Hv), good uniformity, and good adhesion, this type of plating presents very high costs which render this type of solution far from economically convenient and not usable for a large number of industrial applications.

Now according to the present invention, a plated article has been found, as well as a method for its preparation, and an electrolytic bath for application of said plating which enable the drawbacks of the prior art to be overcome.

In particular, a subject of the present invention is an electrolytic bath for the deposition of a plating of boron carbide in a nickel-phosphorus matrix which comprises two or more nickel salts, at least one complexing agent, and at least one phosphorus salt, characterized in that it contains an anti-tensioning agent and boron carbide in the form of powder.

A further subject of the present invention is an article plated with boron carbide in a nickel-phosphorus matrix.

Yet another subject of the present invention is a process for the production of a plating with boron carbide in a nickel-phosphorus matrix, characterized in that it comprises the following steps:

a) preparation of an electrolytic bath comprising two or more nickel salts, at least one complexing agent, at least one phosphorus salt, and, in addition, an anti-tensioning agent and boron carbide in the form of a powder;

b) electroplating of an article in said electrolytic bath at a temperature ranging from 40° C. to 70° C., with a current density ranging from 1 to 10 A/dm$^2$; and c) heat treatment of the product thus plated.

In particular, the electrolytic bath is used for the plating treatment of articles to obtain plated articles having the desired quality.

The main advantage of the plating process according to the present invention consists in that easy management of the entire process is combined with a low cost, and hence excellent possibility of application in the industrial field, and at the same time a plated product is obtained that is provided with high resistance to wear. In addition, a further advantage of the plating obtained using the process according to the present invention lies in its excellent adhesion to the surface of the article to be plated.

The electrolytic bath according to the present invention may comprise, as nickel salts, nickel sulphate and nickel chloride.

Preferably, the electrolytic bath contains, as phosphorus salt, salts of phosphorous acid and of hypophosphorous acid.

The complexing agents are chosen from among citric acid, lactic acid, malic acid, malonic acid, succinic acid, glycolic acid, and short-chain carboxylic acids.

Preferably, the complexing agent is lactic acid.

The anti-tensioning agents are chosen between saccharin and compounds of diethylcarbamic acid, preferably saccharin.

Preferably, the electrolytic bath according to the present invention contains from 0.01 mol. to 3 mol. of nickel sulphate, from 0.003 mol. to 2 mol. of nickel chloride, from 0.006 mol. to 1.8 mol. of the salt of phosphorous acid, from 0.05 mol. to 2 mol. of lactic acid, from 0.2 g/l to 30 g/l of saccharin, and from 0.2 g/l to 30 g/l of boron carbide.

More preferably still, the electrolytic bath according to the present invention contains from 0.1 mol. to 2 mol. of nickel sulphate, from 0.01 mol. to 1.5 mol. of nickel chloride, from 0.06 mol. to 1.0 mol. of the salt of phosphorous acid, from 0.1 mol. to 1 mol. of lactic acid, from 3 g/l to 10 g/l of saccharin, and from 5 g/l to 15 g/l of boron carbide.

In particular, the particles of boron carbide have a grain size of between 3 and 6 $\mu$m.

The said bath can be used with a current density of from 1 to 10 A/dm$^2$, at a temperature ranging between 40° C. and 70° C., under stirring, whilst the pH value of the electrolytic bath may range from 0.4 to 10. The temperature of the bath and the current density for the plating process have been chosen in the range referred to above for the reasons explained in what follows. At temperatures lower than 40° C., the current density would not be sufficient, and there would be a low efficiency of electrodeposition. At temperatures higher than 70° C. the disadvantage of the high evaporation of the bath would exceed the advantage due to an increase in the efficiency of electrodeposition.

Step b) of the plating process according to the present invention is preferably performed at a temperature of 60° C., with a current density of 2 A/dm$^2$, under stirring.

Step c) is performed at a temperature within the 250° C.–400° C. range, and preferably at a temperature of 340° C., for 12 hours.

The material for the cathode is the material to be plated, whilst the anode can be chosen from among anodes made of electrolytic nickel.

In particular, the plated article obtained with the process according to the present invention is a cylinder for the production of corrugated cardboard.

The aforesaid plating can, in any way, be used for any type of article which, in any sector of application, requires plating that is resistant to wear, such as aluminium articles.

The plated article according to the present invention may undergo further treatments, such as a polishing treatment using diamond paste.

In the particular case of an article having a poorly receptive surface, such as a nitrided surface, in order to obtain better adhesion of the plating with boron carbide in a nickel-phosphorus matrix, the plating process according to the invention may be advantageously preceded by the following pre-treatment steps:

1) sanding;
2) chemical degreasing;
3) washing;
4) neutralization in 10% sulphuric acid;
5) washing;
6) deposition of chemical nickel from an alkaline solution at 35–43° C., the said solution being known under the commercial name ENPLATE AL 100; and
7) further washing.

In particular, sanding may be performed using a machine at a pressure of 7 bar and employing corundum with grain size 150; chemical degreasing may be carried out using ultrasound (6 W per litre) at a temperature of 75° C.; the first washing may be carried out in purified water circulated on activated carbon, whilst the washing referred to in point 4) is carried out in purified water circulated on dolomite; deposition of chemical nickel is carried out in cold conditions, keeping the pH value above 9.6 to prevent formation of clouding of the solution and of dark deposits; the final washing consists of a first static washing in deionized water and of a second washing in demineralized water circulated on resins. The plating process according to the invention is then applied on the product thus obtained.

The characteristics and advantages of the product according to the present invention will emerge more clearly from the ensuing detailed description, which is given purely to provide non-limiting examples.

EXAMPLE 1

A plating film consisting of particles of boron carbide in a nickel-phosphorus matrix having a mean thickness of 120 μm was deposited starting from an electrolytic bath containing 72.6 g/l of nickel sulphate, 6 g/l of nickel chloride, 10 g/l of potassium phosphite, 45 g/l of 90% lactic acid, 5.8 g/l of saccharin, and 10 g/l of boron carbide 1500, at a temperature of 60° C., with a maximum current density of 4 A/dm$^2$, under mechanical stirring for 180 minutes.

The hardness of the plating obtained was found to be 650 Hv. After treatment at 340° C. for 12 hours, the plating was found to have a hardness of 950 Hv.

The total phosphorus present in the plating was 2.5% determined under a scanning electron microscope, and the boron carbide present in the plating was 35 vol %.

There was a contained level of evaporation, and tensioning was altogether absent.

EXAMPLE 2

A plating film consisting of particles of boron carbide in a nickel-phosphorus matrix having a mean thickness of 120 μm was deposited starting from an electrolytic bath containing 72.6 g/l of nickel sulphate, 10 g/l of nickel chloride, 10 g/l of potassium phosphite, 80 g/l of 90% lactic acid, 5.8 g/l of saccharin, and 10 g/l of boron carbide 1500, at a temperature of 60° C., with a maximum current density of 4 A/dm$^2$, under mechanical stirring for 180 minutes.

The characteristics of the plating obtained were equivalent to those described for the product of Example 1.

EXAMPLE 3

A plating film consisting of particles of boron carbide in a nickel-phosphorus matrix having a mean thickness of 120 μm was deposited starting from an electrolytic bath containing 72.6 g/l of nickel sulphate, 3 g/l of nickel chloride, 5 g/l of potassium phosphite, 90 g/l of 90% glycolic acid, 5.8 g/l of saccharin, and 10 g/l of boron carbide 1500, at a temperature of 60° C., with a maximum current density of 4 A/dm$^2$, under mechanical stirring for 180 minutes.

The characteristics of the plating obtained were equivalent to those described for the product of Example 1.

EXAMPLE 4 (COMPARATIVE)

A plating film consisting of particles of boron carbide in a nickel-phosphorus matrix having a mean thickness of 120 μm was deposited starting from an electrolytic bath containing 66 g/l of nickel sulphate, 12 g/l of nickel chloride, 5 g/l of phosphorous acid, 45 g/l of 90% lactic acid, and 6 g/l of boron carbide, at a temperature of 70° C., at a pH of 4, and at a current density of 2 A/dm$^2$, for 120 minutes.

In these conditions, excessive anodic etching was found which was due to the excessively high content of chlorides, a low presence of inert particles—in fact, the boron carbide present was 23.4 vol %—, excessive evaporation due to the excessively high temperature, severe internal tensioning, and low deposition rate.

Also this electroplated specimen underwent heat treatment at 340° C. for 12 hours.

The hardness of the plating obtained was found to be 1050 Hv. The total thickness of the plating was 66 μm, with a thickness in the groove of 44 μm. There was thus a difference in thickness between the sharp point and the groove of 33.4%.

The total phosphorus present in the plating was 4.7% determined under a scanning electron microscope. Tensioning, due to the absence of saccharin, was very evident in the specimen.

EXAMPLE 5

A wear test was carried out comparing the plating obtained according to Example 1 with a plating consisting of electrolytic chromium and with a tungsten-carbide plating deposited using the "super detonation gun" technique.

The test was carried out by putting the three test specimens simultaneously on a metallographic lapping machine and using, as abrasive means, a 1200-type lapping paper with water at room temperature, loading for 4 minutes with a force of 4030 kg.

The comparison was made by measuring the thickness before and after the test by means of an optical micrometer at ×800. The following results were obtained:

The plating of Example 1 in nickel-phosphorus plus boron carbide presented wear for a thickness of 45 μm;

The tungsten-carbide plating presented wear for a thickness of 30 μm;

The electrolytic-chromium-plating presented wear for a thickness of 65 μm.

It was therefore found that, setting the wear undergone by the tungsten plating equal to zero corresponding to a wear resistance equal to one hundred, the plating in nickel and phosphorus with boron carbide underwent twice the wear of the tungsten plating and presented a wear resistance 66% higher than that of an electrolytic-chromium plating.

It was therefore surprisingly found that boron carbide, by contributing to lowering the friction coefficient, makes it possible to achieve a higher wear resistance of the plating as compared to an electrolytic-chromium plating.

It was moreover found that, after approximately 12 hours of operation, the chemical parameters of the electrolytic solution or bath no longer fell within the pre-defined values. This applied in particular to the pH and to the metallic nickel. After 12 hours it is therefore necessary to treat the electrolytic solution, allowing the particles to settle for 24 hours and restoring the level by treating with a solution containing ammonium sulphate, ammonium chloride, phosphorous acid, lactic acid, potassium hydrate, and saccharin.

The main advantage of the plating process according to the present invention hence lies in combining easy management of the entire process with a low cost, and hence with an excellent possibility of industrial application, at the same time obtaining a plated article provided with a high level of wear resistance.

Furthermore, another advantage of the plating obtained with the process according to the present invention consists in the excellent adhesion that it presents to the highly critical surface of the article to be plated.

What is claimed is:

1. A process for the production of a plating of boron carbide in a nickel-phosphorus matrix, comprising the following steps:

a) preparing an electrolytic bath comprising two or more nickel salts, at least one complexing agent, at least one phosphorus salt, an anti-tensioning agent, and boron carbide in the form of powder;

b) electroplating an article in said electrolytic bath at a temperature ranging from 40° C. to 70° C., with a current density ranging from 1 to 10 A/dm$^2$, under stirring; and c) heat treating the plated article.

2. A process according to claim 1, wherein b) is performed at a temperature of 60° C., with a current density of 2 A/dm$^2$, under stirring.

3. A process according to claim 2, wherein c) is performed at a temperature of 340° C., for 12 hours.

4. A process according to claim 2, wherein, prior to a), the following pre-treatment steps:

1) sanding;

2) chemical degreasing;

3) washing;

4) neutralizing in 10% sulphuric acid;

5) washing;

6) depositing chemical nickel from an alkaline solution at 35–43° C., said solution having a low phosphorus content; and 7) further washing, are performed.

5. A process according to claim 4, wherein the deposition of chemical nickel is carried out in cold conditions, keeping the pH value above 9.6.

6. A process according to claim 5, wherein the article is aluminum.

7. A process according to claim 5, wherein the article is a cylinder for the production of corrugated cardboard.

8. A process according to claim 5, wherein the article is subsequently finished and polished.

9. A process according to claim 8, wherein the article is polished with a diamond paste.

10. A process according to claim 1, wherein c) is performed at a temperature of between 250° C. and 400° C.

11. A process of plating an article with boron carbide in a nickel-phosphorus matrix in an electrolytic bath comprising two or more nickel salts, at least one complexing agent, at least one phosphorus salt, an anti-tensioning agent, and boron carbide in the form of powder, comprising:

electroplating an article in said electrolytic bath at a temperature ranging from 40° C. to 70° C., with a current density ranging from 1 to 10 A/dm$^2$, under stirring; and heat treating the plated article.

12. A process according to claim 11, wherein the electroplating is performed at a temperature of 60° C., with a current density of 2 A/dm$^2$, under stirring.

13. A process according to claim 12, wherein, prior to electroplating, the following pre-treatment steps:

1) sanding;

2) chemical degreasing;

3) washing;

4) neutralizing in 10% sulphuric acid;

5) washing;

6) depositing chemical nickel from an alkaline solution at 35–43° C., said solution having a low phosphorus content; and 7) further washing, are performed.

14. A process according to claim 13, wherein the deposition of chemical nickel is carried out in cold conditions, keeping the pH value above 9.6.

15. A process according to claim 14, wherein the article is aluminum.

16. A process according to claim 14, wherein the article is a cylinder for the production of corrugated cardboard.

17. A process according to claim 14, wherein the article is subsequently finished and polished.

18. A process according to claim 14, wherein the article is polished with a diamond paste.

19. A process according to claim 11, wherein the heat treating is performed at a temperature of between 250° C. and 400° C.

20. A process according to claim 11, wherein the heat treating is performed at a temperature of 340° C., for 12 hours.

21. A process of electroplating an article with boron carbide in a nickel-phosphorus matrix in an electrolytic bath comprising two or more nickel salts, at least one complexing agent, at least one phosphorus salt, an anti-tensioning agent, and boron carbide in the form of powder, comprising:

electroplating an article in said electrolytic bath at a temperature ranging from 40° C. to 70° C., with a current density ranging from 1 to 10 A/dm$^2$, under stirring.

22. A process according to claim 21, wherein the electroplating is performed at a temperature of 60° C., with a current density of 2A/dm$^2$, under stirring.

23. A process according to claim 22, wherein, prior to electroplating, the following pre-treatment steps:

1) sanding;

2) chemical degreasing;

3) washing;

4) neutralizing in 10% sulphuric acid;

5) washing;

6) depositing chemical nickel from an alkaline solution at 35–43° C., said solution having a low phosphorus content; and 7) further washing, are performed.

24. A process according to claim 23, wherein the deposition of chemical nickel is carried out in cold conditions, keeping the pH value above 9.6.

25. A process according to claim 24, wherein the article is aluminum.

26. A process according to claim 24, wherein the article is a cylinder for the production of corrugated cardboard.

27. A process according to claim 24, wherein the article is subsequently finished and polished.

28. A process according to claim 27, wherein the article is polished with a diamond paste.

29. In a process for electroplating an article, wherein the improvement comprises electroplating an article in an electrolytic bath which comprises two or more nickel salts, at least one complexing agent, at least one phosphorus salt, anti-tensioning agent, and boron carbide in the form of powder, at a temperature ranging from 40° C. to 70° C., with a current density ranging from 1 to 10 $A/dm^2$; under stirring.

* * * * *